United States Patent [19]

Hattori

[11] Patent Number: 4,795,384

[45] Date of Patent: Jan. 3, 1989

[54] BAND MOUNTING APPARATUS FOR A DIVING FIN

[76] Inventor: Seiji Hattori, 5-18, Hadori 4-chome, Fujisawa-shi, Kanagawa, Japan

[21] Appl. No.: 60,852

[22] Filed: Jun. 12, 1987

[30] Foreign Application Priority Data

Nov. 12, 1986 [JP] Japan ..... 61-173691

[51] Int. Cl.[4] ..... A63B 31/11

[52] U.S. Cl. ..... 441/64; 24/170; 24/191; 24/193

[58] Field of Search ..... 441/61–64; 24/168, 170, 191, 193

[56] References Cited

U.S. PATENT DOCUMENTS 4,102,343 7/1978 Schneider ..... 24/191
4,669,155 6/1987 Chen ..... 24/170

FOREIGN PATENT DOCUMENTS 1182862 6/1959 France ..... 441/64

*Primary Examiner*—Sherman D. Basinger
*Attorney, Agent, or Firm*—Cushman, Darby & Cushman

[57] ABSTRACT

A band mounting for a diving fin is provided to fix a foot on a diving fin body. The construction of the mounting enables one to draw freely on an end of the band in its fastening direction while enabling a user to firmly lock the end of the band in its loosening direction.

4 Claims, 5 Drawing Sheets

BAND MOUNTING APPARATUS FOR A DIVING FIN

BACKGROUND OF THE INVENTION

1. Field of the Invention

This invention relates to a band mounting means for a diving fin which is mounted to fix a foot on a diving fin body. More particularly, the present invention makes it possible to draw freely on an end of the band in its fastening direction while it is possible to firmly lock the end of the band in its loosening direction. In addition, it is easy to dismount and assemble the body when exchanging parts.

2. Description of the Prior Art

It is known that a foot inserting portion of a submarine or diving fin is, at its one side and the other side respectively, provided with a band mounting member, so that one end and the other end of a band can be locked or unlocked by the band mounting members.

According to a conventional band mounting member when fixing a foot firmly on the submarine fin, it is required to pull an end of the band freely in a fastening direction, while to lock the band firmly in a loosening direction of it. Further, the aforesaid band mounting member has such a structure that even during an operation in water a foot cannot be detached from the diving fin due to loosening of the band or the band can be loosened easily when removing the diving fin.

More specifically such band mounting member comprises two parallel pins disposed between a leftside wall and a rightside wall of a body frame. Each pin is fixed, at an external side of both the leftside and rightside walls of the body frame, with the body frame by means of an E-clip. One of the two pins is provided with a band lock plate having a belt provided with a plurality of tapered lugs equally spaced with each other. The lock plate includes a pawl to be engaged with the lugs of the belt. When drawing the belt in a fastening direction, its pawl and the lug are disengaged from each other. It is possible to fasten the band freely. Particularly, when detaching the fin from a foot, it is possible to disengage the pawl freely from the lug of the belt, thereby drawing the belt in its loosening direction.

As discussed above, the band mounting member of such a conventional diving fin enables a firm fixature of the fin with the foot only by drawing an end of the band in its fastening direction during a subsea working. Thus, loosening of the band is not possible, and it is very easy to dismount the fin on the ground.

The band of such diving fins are mainly fabricated of a rubber material or the like. As this band is being repeatedly fastened or loosened, it is apt to be fatigued. In addition, it is used in the water. Accordingly, it is necessary to replace a worn, used band with a new band prior to the fatigue of the used band. Further, there is the possibility that a band may be injured or broken, during the subsea working, due to its contact with a rock on the sea bed. In that case, it is required to immediately replace the broken band with a new band.

When replaced with a new band, the pins fixed on the frame must be dismounted by separating the E-clips by means of a tool. After a new band has been mounted, the two pins must be again inserted into the frame and fixed by the E-clips by means of such a tool.

As described above, because the two pins respectively are fixed by a small E-clip, it is very cumbersome to mount or dismount such E-clips one after another. In addition, it is difficult to replace with a new band without using the tool. Therefore, it has been demanded to exchange the band more quickly and easier. Further, since the E-clips are disposed outside the frame, during the subsea working they may be damaged easily. Thus, there may arise the possibility that the fixation of the pins may be unstable or the pins may be slipped off due to the damage of the E-clips, thereby the band mounting member may be malfunctioned. Thus, a firm fixation of the pins has been demanded.

BRIEF SUMMARY OF THE INVENTION

Accordingly, it is an object of this invention to provide a band mounting means for diving fins, in which the pins can be dismounted or assembled easily and quickly when exchanging the band, and the band can be firmly fixed with a main body frame.

More specifically, the band mounting means of a diving fin comprises a band for fixing a foot in a foot inserting portion of the diving fin; said band being supported between one side and the other side of the foot inserting portion; a first pin for rotating the band within a body frame; and a second pin for supporting a locking member for locking or unlocking said band in a fastening direction Y or in a loosening direction Z under a constantly closed pressure by a spring; so that the first and second pins are being fixed with the body frame.

The band mounting means is characterized in that when inserting the first pin and the second pin into the body frame, the first and second pins respectively are provided with a first groove and a second groove so as to be positioned within a gap between the body frame and the locking member, and a single pin stopper plate is removably disposed in the gap.

Further, one side of the pin stopper plate is provided with a smaller hole than the diameter of the second pin and the smaller hole is communicated with an edge and a cutaway portion of the pin stopper plate. While the other side of the pin stopper plate is provided with a larger hole and a smaller hole than the diameter of the first pin, and the larger and smaller hole, is communicated with each other through a path, and the smaller hole is communicated with the edge. The cutaway portion and the cutaway portion and the path are formed contrary relative to a drawing direction X of the pin stopper plate, while the cutaway portion is formed in a sideward direction.

Other and further objects and features of this invention will more fully be understood from the following description of embodiments with reference to the accompanying drawings.

BRIEF DESCRIPTION OF THE ACCOMPANYING DRAWINGS

DETAILED DESCRIPTION OF THE EMBODIMENTS

Preferred embodiments of this invention will now be described with reference to FIGS. 1 to 6.

Figure 1A:
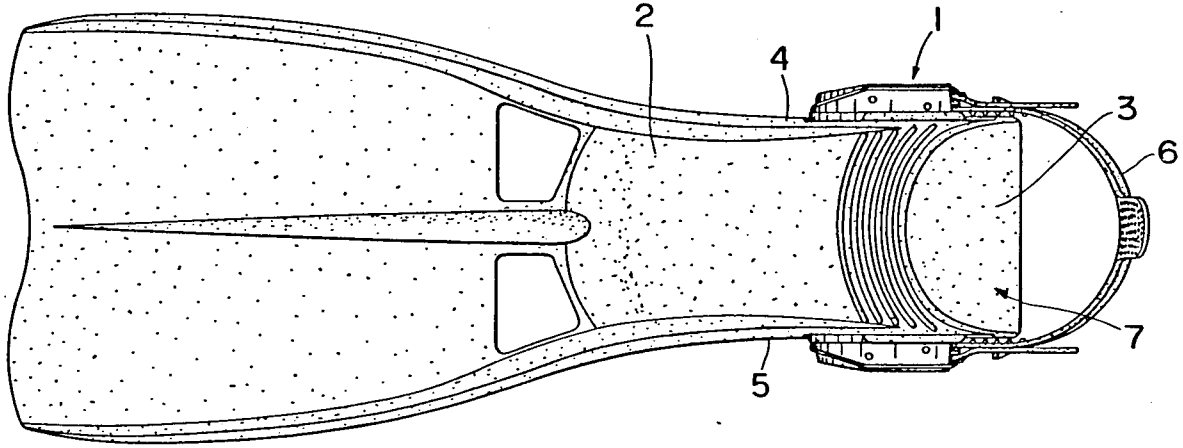
FIG. 1(A) is a plan view of a diving fin according to this invention, in which a band mounting means is mounted on the diving fin.
Figure 1B:
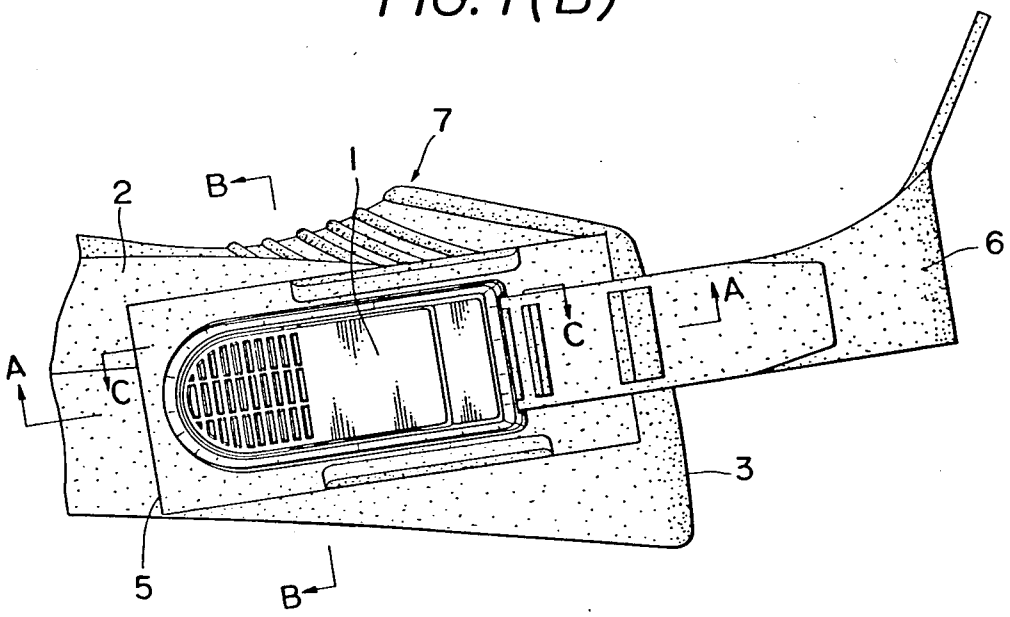
FIG. 1(B) is a side view of the diving fin, in which the band mounting means is enlarged.

In FIGS. 1A and 1B. numeral 1 denotes a mounting body which is fixed with one side of and the other side of a foot inserting portion 3 formed on a rear part of a submarine fin 2. The mounting body 1 is effective to hold a foot on the diving fin 2 by means of a band 6.

Figure 2:
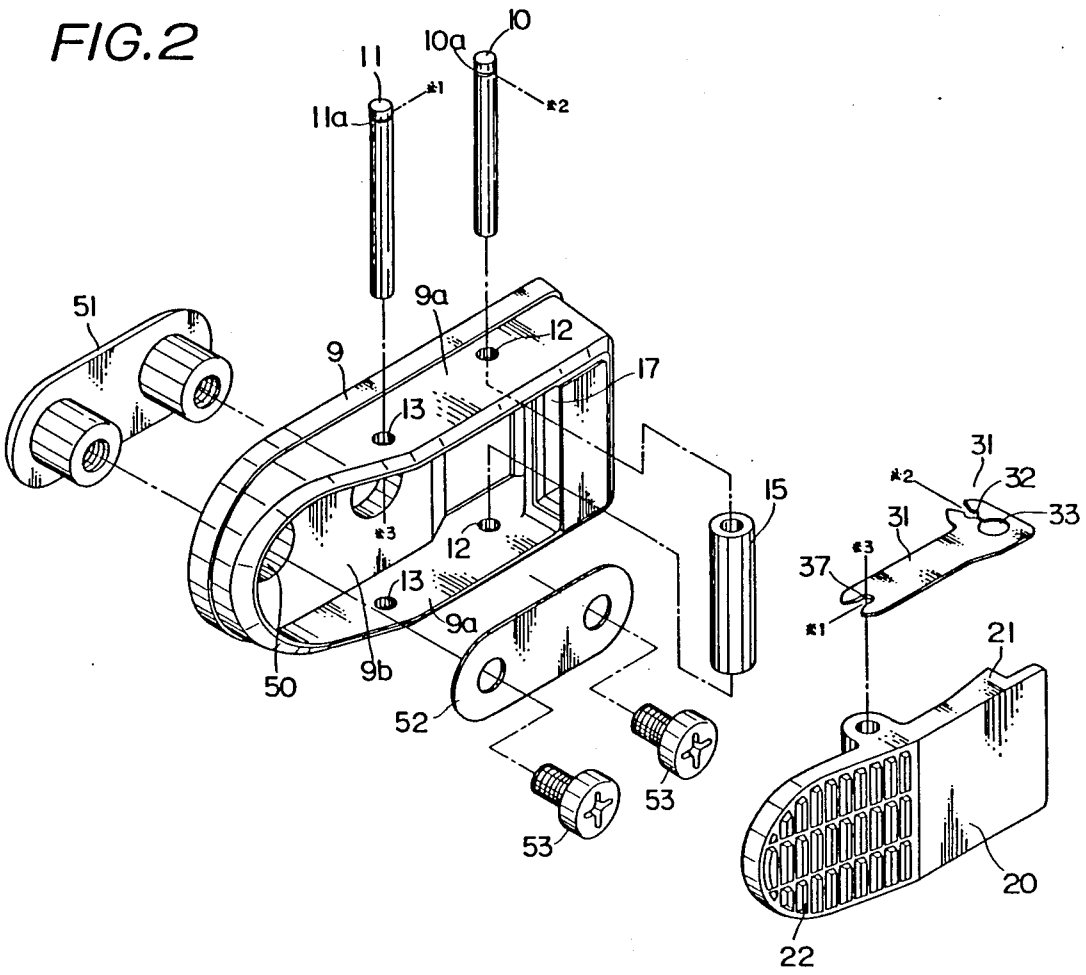
FIG. 2 is an exploded view of the band mounting means.
Figure 3:
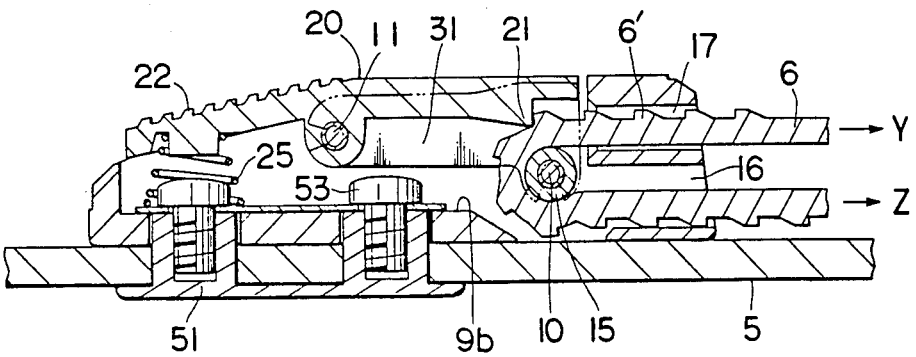
FIG. 3 is a section view taken on line A—A of the band mounting means in FIG. 1(B).
Figure 5:
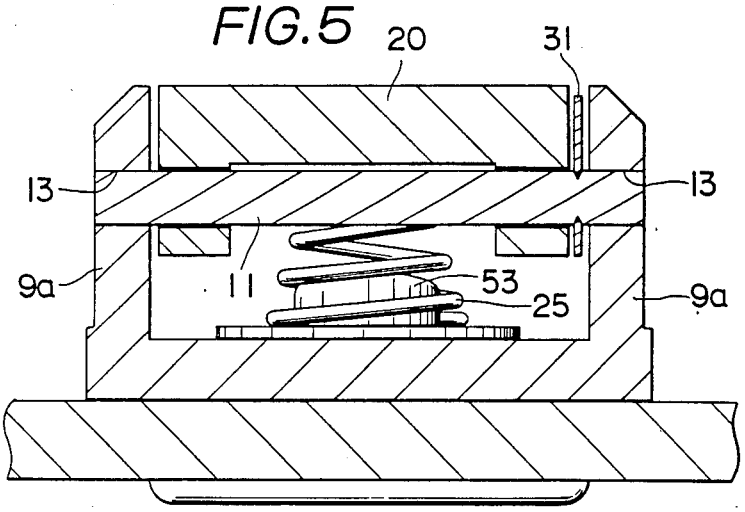
FIG. 5 is a section view taken on line B—B showing the condition after the mounting of the pin stopper plate.

In FIG. 2 numeral 9 denotes a body frame consituting the mounting body 1, and a horizontal section of the body frame 9 is of a nearly concave shape as shown in FIG. 5.

The frame 9 is, at its left-side and right-side walls, provided with first pin holes 12, 12 and second pin holes 13, 13, where the first pin holes 12, 12 are effective to insert therein a first pin 10 to wind the band 6, while the second pin holes 13, 13 are effective to insert therein a second pin 11 to lock or unlock the band.

To introduce the band 8 into the mounting body 1, a rotary member 15 is pivoted about the first pin 10 wherein a first band inserting opening 18 and a second band feeding opening 17 are provided at the first pin for winding the band 8. The band 6 is introduced into the mounting body 1 from the band inserting opening 16 then bound about the pin 10 and the rotary member 15 and fed out through the second band feeding opening 17.

In order to lock or unlock the band 6 as introduced above, the second pin 11 is provided with a locking ember 20 pivotted swingingly on the second pin 11. The locking member 20 comprises a locking pawl 21 of convex form projected inwardly of the frame 9, and the locking pawl 21 is positioned in the rear portion of the diving fin 2. The locking pawl 21 is pressed downwardly on a bottom surface 8 of the frame 9 by means of a spring which is disposed between an end 22 of the locking member 20 and the bottom surface of the frame. Further, the band 6 comprises a plurality of tapered lugs 6' equally spaced from each other.

Figure 4:
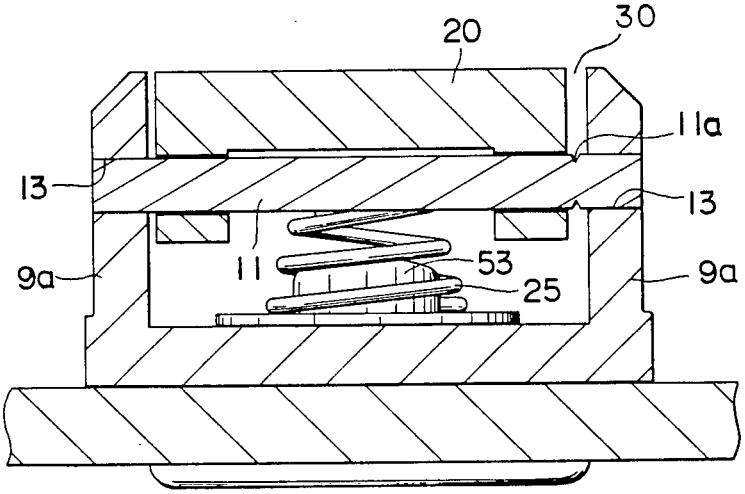
FIG. 4 is a section view taken on line B—B showing the condition prior to the mounting of a pin stopper plate.

Each of the pins 10, 11 is, as shown in FIG. 2, provided with groove 10*a* and 10*b* respectively to fix them in the frame 9. As shown in FIG. 4, when inserting the pins 10 and 11 into the frame 9, the grooves 10*a* and 11*a* are formed so that they can be positioned in a gap 30 between the frame 9 and the locking member 20.

As shown in FIG. 5, there is shown a single pin stopper plate 31 which is disposed in the gap 30 between the frame 9 and the locking plate 20. The pin stopper plate 31 is engaged with the grooves 10*a*, 11*a* in order to fix the pins 10, 11.

Figure 6:
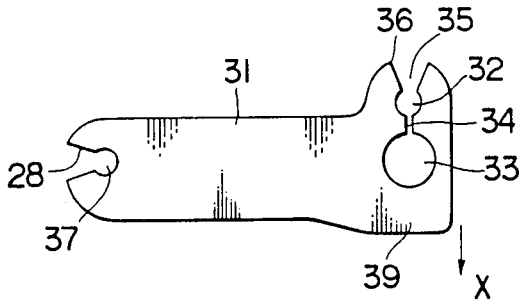
FIG. 6 is a plan view of the pin stopper plate.

The structure of the pin stopper plate 31 will now be described with reference to FIG. 6.

The pin stopper plate 31 is, at its one end, provided with a smaller hole 32 to be fit for the first groove 10*a* of the first pin 10, as well as with a larger hole 33. The diameter of the hole 32 is smaller than that of the pin 10. Further, the smaller hole 32 is communicated with the larger hole by way of a path 34. The smaller hole 32 is open for a cutaway portion 35 having an edge 36. The other end of the pin stopper plate 31 is a hole 37 which is smaller than the diameter of the second pin 11. The hole 37 is open for a cutaway portion 38. The path 34 and the cutaway 35 at one end of the pin stopper plate 31 are formed in a contrary relative to a drawing direction of the pin stopper plate 31 as shown by as arrow X. The cutaway portion 38 formed at the other end of the pin stopper plate 31 is formed sideways relative to the drawing direction of the pin stopper plate 31.

The smaller holes 32 and 37 as well as the cutaway portions 35 and 38 are formed to be enlarged toward the edge 36.

As described above, since the pin stopper plate 31 is disposed between the frame 9 and the locking member 20, a grip portion 39 is formed to draw out the plate 31. When mounting the body 1 having such construction on the diving fin 2, both sides 4 and 5 of the diving in 2 must be perforated, and a screw receiving member 51 is inserted into two holes inwardly of the foot inserting portion 3. On the other hand, there are formed two holes 50 on a bottom surface 96 of the frame 9. Thus, the screw receiving member 51 inserted into two holes 50 are firmly screwed and fixed with two screws 53, 53 by way of a washer. A motion of this embodiment will be described.

When replacing with a new band or disassembling some mounting members, it is required to draw a pin stopper plate 31 to fit in the pins 10 and 11, in the gap between the frame 9 and the rocking member 20. On the other hand, since the cutaway portion 38 engaged with the second pin 11 is formed sideways relative to a drawing direction X, one end of the pin stopper plate 31 cannot be separated from the second pin 11. On the other hand, since the cutaway portions 34, 35 in which the first pin is inserted are disposed contrary relative to a drawing direction X, the other end of the pin stopper plate 31 is separated from the first pin 10.

Figure 7:
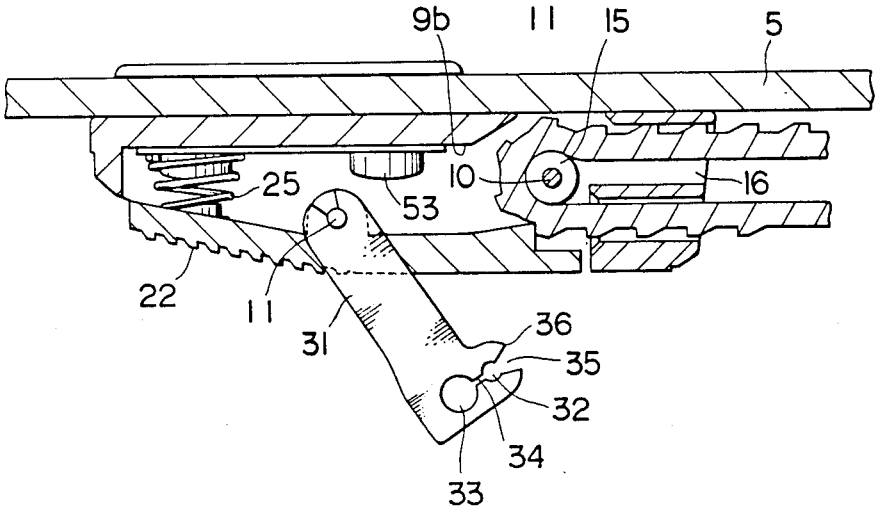
FIG. 7 is a section view taken on line C—C of the band mounting means in FIG. 1(B) showing the condition in which one side of the pin stopper plate is drawn out.

As shown in FIG. 7, a free end of the pin stopper plate 31 is rotatable about the first pin 11. Due to this rotation the cutaway portion 38 is positioned contrary relative to the drawing direction, thereby one end of the pin stopper plate 31 is separated from the second pin. When the pin stopper plate 31 has completely been drawn out, the first pin 10 and second pin 11 are not supported by any fixing means, so that they are completely separated from the frame 8. Accordingly, it is easy to mount or dismount the locking member 20 and the band 6. In this way, only by drawing the pin stopper plate 31, it becomes possible to dismount the two pins 10, 11 and disassemble the body.

When assembling the body, the first and second pins 10, 11 are inserted into the pin holes 12, 13. Because the two pins are not fixed by any means, they have to be supported by hand. After that, one end of the the pin stopper plate 31 is to be inserted into the gap between the frame 9 and the locking member 20, while the cutaway portion 38 is engaged with the second pin 11.

The holes 32 and 38 to be engaged with the first and second pins 10 and 11 respectively are communicated with the cutaway portions 35 and 38 which are diverged gradually in a peripheral direction, so that the first and second pins 10 and 11 are engaged with the smaller holes 32, 37. Thus, the pin stopper plate 31 is rotatable about the second pin 11 as a fulcrum. Therefore, an end of the pin stopper plate 31 can be directed to the first pin 10 by the guide of the second pin 11. When pressing the end of the pin stopper plate 31, the first pin 32 is firmly inserted into the hole 33 by the resilience of the smaller hole 32 and the path 34. The pin stopper plate 31 is between the frame 9 and the locking member 20, and in addition, the grooves 10*a*, 11*a* of the first and second pins 10, 11 respectively are forcibly engaged with the smaller holes 32, 37. Accordingly, the pin stopper plate 31 cannot be separated without drawing out it. Further, since the pin stopper plate 31 is positioned inside the frame 7, it can never be damaged and support the first and second pins 10, 11 strongly.

As described previously the band 6 is provided with a plurality of tapered lugs 6' equally spaced with each other. The locking pawl 21 of the locking member 20 is always pressed downwardly by the spring 25, so that it is engaged with the lug 6' under pressure. Thus, when drawing the band to in a fastening direction of the band 6 as shown by arrow Y, the locking pawl 6' and the tapered lug 6' are disengaged from each other, and the pawl 6' is engaged with a pawl lug 6'. Therefore, even when drawing the band 6 in a loosening direction as shown by arrow Z, the pawl 21 cannot be disengaged from the lug 6', so that the band 6 is firmly locked. Thus, the band 6 can be drawn only in a fastening direction Y.

When a user does not want to loosen the band 6, its pawl 21 cannot be pressed by the spring 25 by pressing the end 22 of the locking member 20 downwardly, thereby the pawl 21 is separated from the band 6. Thus, the pawl 21 is disengaged from the tapered lug 6'.

The function of this invention will now be described.

When exchanging the band and dismounting parts, it is required to draw the pin stopper plate 31 engaged with the first and second pins 10, 11, which stopper plate is disposed between the frame 9 and the locking member 20. Since the cutaway portion 38 engaged with the second pin 11 is formed sideways against a drawing direction X, one end of the pin stopper plate 31 cannot be separated from the second pin 11. However, since the cut away portions 34, 35 engaged with the first pin 10 are formed contrary relative to a drawing direction X, the other end of the pin stopper plate 31 is separated from the first pin 10. A free end of the pin stopper plate 31 is rotated about the second pin 11 as a fulcrum. Due to this rotation, the cutaway portion 37 is positioned contrary to a drawing direction X, as a result of which the one end of the pin stopper plate 31 is separated from the second pin 11. When the pin stopper plate 31 has completely been drawn out the first and second pins 10, 11 are not secured by any fixing means, so that they are slipped off from the frame 9. Therefore, it is free to mount or dismount the band 8 and the locking member 20. In this way dismounting of the two pins 10, 11 and disassembling of the body can be carried out easily.

In assembling, the first and second pins 10, 11 must be inserted, supporting them by band. One end of the pin stopper plate 31 is inserted into the gap 30 between the frame and the locking member 20, and the cutaway portion 38 is engaged with the second pin 11. The cutaway portion 38 is rotated about the second pin 11 as a fulcrum. Therefore, the other end of the pin stopper plate 31 reaches the first pin 10 by the guide of the second pin 11. When pressing the plate 31, the cutaway portions 34, 35 are enlarged by the resilience of the holes 32, 33, thereby the first pin 10 are inserted therein.

Disassembling is also simple. The pin stopper plate 31 is inserted into the gap 30 between the frame 9 and the locking member 20, and in addition, the smaller holes 32, 37 are, under pressure, engaged with the grooves 10*a*, 11*a* of the first and second pins 10, 11. Thus, the pin stopper plate 31 cannot be slipped off. Still further, since it is disposed inside the body frame 9, it can never be damaged and can support the two pins 10, 11 strongly.

As discussed previously, the band mounting means of a diving fin according to this invention provides a very easy dismounting and assembling of the body.

More specifically, it is unnecessary to fix the first pin for winding the band and the second pin for supporting the locking member by means of respective small E-clips. According to this invention, the above two pins can be fixed by means of a single pin stopper plate without using any tool. Further, it is very easy to exchange the used band and mount or dismount the two pins.

Further, one end of the pin stopper plate is provided with a smaller hole than the diameter of the second pin, and the smaller hole is communicated with a cutaway portion. On the other hand, the other end thereof is provided with a smaller hole and a larger hole than the diameter of the first pin, and both the smaller and larger holes are communicated with two cutaway portions as well as an edge of the pin stopper plate. The two cutaway portions are formed contrary to a drawing direction of the pin stopper plate, while the other cutaway portion is formed in a sidewise direction of the pin stopper plate. Thus, when the second pin is engaged with the other cutaway portion, a free end of the pin stopper plate is rotatable and can firmly be engaged and fixed with the first pin by guide of the second pin. The first pin can be engaged with the larger pin by the resilience of the smaller hole. Accordingly, the pin stopper plate cannot be slipped off.

Still further, since the pin stopper plate can be disposed between the frame body and the locking member, it can never be damaged due to any external force and can be secured firmly by means of the two pins.

Thus, the present invention exhibits various useful effects and practical advantages.

What is claimed is:

1. A band mounting apparatus for securing the foot of a person to a diving fin or the like having a foot inserting portion, comprising:

a body frame;

band means for securing the foot of a person in the foot inserting portion;

first pin means supported by said body frame for supporting said band means for rotation thereabout and having a groove defined therein;

a second pin supported by said body frame;

a locking member rotatably supported with respect to said frame by said second pin, said lock member having means thereon for engaging said band means for preventing said band means from slipping in a loosening direction;

means for biasing said band engaging means against said band means; and a pin stopper plate rotatably supported by said second pin and having means thereon for engaging said groove in said first pin means so as to secure said first pin means to said body frame, whereby the first pin means may be easily removed by disengaging the pin stopper plate therefrom.

2. Apparatus according to claim 1, in which one end of said pin stopper plate is provided with a hole that is smaller than the diameter of said second pin, said hole being communicated with an edge and a cutaway portion of said pin stopper plate, while the other end of said pin stopper plate is provided with a second hole that is large and a third hole that is smaller than the diameter of said first pin means, said second and third holes being communicated with each other through a path, and said second hole being communicated with the edge.

3. Apparatus according to claim 1, wherein said second pin has a second groove defined therein for receiving said pin stopper plate, whereby said second pin may also be removed by disengaging the pin stopper plate therefrom.

4. Apparatus according to claim 1, wherein said band engaging means comprises a pawl, and said band means includes a number of pawl lugs for engaging said pawl.

* * * * *